US007091912B2

(12) United States Patent
Iacovella et al.

(10) Patent No.: US 7,091,912 B2
(45) Date of Patent: Aug. 15, 2006

(54) VEHICULAR ANTENNA WITH IMPROVED SCREENING

(75) Inventors: Federico Iacovella, Vicenza (IT); Roberto Ronzani, Vicenza (IT)

(73) Assignee: Calearo Antenne S.R.L., Milan (IT)

( * ) Notice: Subject to any disclaimer, the term of this patent is extended or adjusted under 35 U.S.C. 154(b) by 0 days.

(21) Appl. No.: 10/531,190

(22) PCT Filed: Oct. 14, 2003

(86) PCT No.: PCT/EP03/11375

§ 371 (c)(1),
(2), (4) Date: Apr. 13, 2005

(87) PCT Pub. No.: WO2004/036686

PCT Pub. Date: Apr. 29, 2004

(65) Prior Publication Data

US 2006/0038726 A1 Feb. 23, 2006

(30) Foreign Application Priority Data

Oct. 15, 2002 (IT) ..... VI2002A0212

(51) Int. Cl.
*H01Q 1/32* (2006.01)

(52) U.S. Cl. ..... 343/713; 343/711; 343/725; 343/872

(58) Field of Classification Search ..... 343/713, 343/711, 872, 725, 712, 715, 700 MS
See application file for complete search history.

(56) References Cited

U.S. PATENT DOCUMENTS 5,835,071 A 11/1998 Phelps
5,959,585 A * 9/1999 Militz ..... 343/713

FOREIGN PATENT DOCUMENTS

EP 0891001 A1 1/1999
EP 0989629 A1 3/2000

* cited by examiner

*Primary Examiner*—Tho Phan
*Assistant Examiner*—Chuc Tran
(74) *Attorney, Agent, or Firm*—IP Strategies

(57) ABSTRACT vehicle antenna (1) comprising a satellite signal amplifier and/or receiver circuit (2) assembled on a board (6), an antenna base (3) for support of said board (6), applicable to the structure of a vehicle (A), connection means (7) to mechanically fix said board (6) to said antenna base (3), a coaxial cable (8) that connects the satellite signal amplifier and/or receiver circuit (2) to a receiving apparatus installed in the vehicle (A). Between the antenna base (3) and the board (6) electro-conductive elastic means (13) are interposed to achieve electricity continuity between the antenna base (3) and the metallic braiding (8*b*) of the coaxial cable (8) when the connection means (7) fix the board (6) to the antenna base (3).

16 Claims, 4 Drawing Sheets

VEHICULAR ANTENNA WITH IMPROVED SCREENING

This application is a 371 of PCT/EP 03/11375 Oct. 14, 2003.

FIELD OF THE INVENTION

The invention concerns a vehicular antenna with improved screening for receiving satellite signals and telephone communications.

BACKGROUND OF THE INVENTION

It is known that to receive satellite signals and to enable telephone communications from vehicles the so-called "combined" antennas are used, provided with a single antenna base applied to the vehicle structure, which supports a satellite signal amplifier and/or receiver circuit and a monopole for telephone communications.

One of the most important characteristics of these combined antennas is their ability to guarantee the correct reception of the satellite signal even during telephone communications.

However, it is known that during telephone communications the signal which is sent forth is partly picked-up by the satellite signal amplifier and/or receiver and this affects the good reception of the signal itself by the satellite navigation system installed in the motor vehicle.

To this purpose, specially designed techniques set the decoupling value between the telephone signal and the satellite signal and therefore they substantially define the maximum acceptable power of the interfering signal that can be absorbed by the satellite amplifier and/or receiver.

To obtain the decoupling of the antennas, it is necessary to insulate the satellite signal amplifier and/or receiver circuit, so as to prevent the entry of the signal coming from the telephone antenna.

According to a known technique, the problem is solved by encapsulating the satellite signal amplifier and/or receiver inside a metal casing that can be electrically insulated or connected to the structure ground through contact.

The patent application no. EP 0 989 629 describes an example of this kind, that is, a vehicular antenna, a portion of which is of GPS (Global Positioning System) type for satellite communications, while the other portion is a telephone antenna for telephone communications, said vehicular antenna being extremely compact.

According to another known technique, the problem can be solved by fixing the satellite signal amplifier and/or receiver to the base of the antenna, which is suitably shaped, so as to eliminate any opening through which the telephone transmission signal can enter and interfere with the satellite signal amplifier and/or receiver.

Said types of insulation, however, present the drawback of being rather expensive to produce.

Furthermore, the coaxial cable coming from the satellite navigation system installed in the motor vehicle connects to the satellite signal amplifier and/or receiver circuit passing through said suitable shaping made on the base of the antenna.

Through this shaping the signal emitted by the telephone antenna can reach the satellite signal amplifier and/or receiver circuit and only by means of perfect welding either on the base or on the casing, it is possible to obtain an optimal closing of the cable passage area and therefore an optimal ground contact.

BRIEF SUMMARY OF THE IVENTION

The present invention aims to overcome the drawbacks listed above.

In particular, one of the main objectives of the invention is the implementation of a vehicular antenna with improved screening, whose degree of insulation from the electromagnetic waves of the satellite signal amplifier and/or receiver circuit is better than that offered by combined antennas of the known type.

Practically, the intention is to create a sort of physical barrier to the electromagnetic waves of the telephone signal that may disturb the reception of the satellite signal.

Another objective of the invention is to simplify the constructive structure of the vehicular antenna, in such a way as to reduce its production cost compared to that of the known equivalent antennas.

More precisely, the aim is to guarantee a suitable ground contact in correspondence with the coaxial cable passage area, eliminating any welding between the coaxial cable and the base of the antenna or a metal casing.

The objectives mentioned above are achieved through the implementation of a vehicular antenna that, according to the main claim, comprises:

- at least one satellite signal amplifier and/or receiver circuit assembled on a board provided with at least one earth plane;
- an antenna base to support said board, attachable to the vehicle structure;
- connection means suitable for mechanically fixing said board to said antenna base and for achieving electricity continuity between said antenna base and said at least one earth plane of said board;
- a coaxial cable that connects said satellite signal amplifier and/or receiver circuit to a receiving apparatus installed in said motor vehicle, and is characterised in that it comprises electro-conductive elastic means interposed between said antenna base and said board, and suited to constitute a barrier to prevent the interference of the telephone communication signal with the satellite communication signal and to achieve electricity continuity between said antenna base and the metallic braiding of said coaxial cable when said connection means fix said board to said antenna base.

According to the preferred embodiment that is described here below, the means for the connection of the board to the antenna base are rivets and the electro-conductive elastic means consist of a metal foil shaped in such a way as to make it elastic.

According to other embodiments, the conductive elastic means consist of a shaped body made of an elastomer loaded with conductive elements.

To advantage, the antenna object of the invention, compared to known antennas, produces greater decoupling between the satellite signal amplifier and/or receiver and the monopole for telephone communications.

Consequently, it is less sensitive to interferences.

Another advantage offered by the antenna object of the invention is represented by the fact that it doesn't require welding operations and therefore it is quicker, simpler and less expensive to construct than equivalent known antennas.

BRIEF DESCRIPTION OF THE DRAWINGS

The objectives and advantages described above will be highlighted in greater detail in the description of a preferred embodiment of the invention, with reference to the attached drawings, wherein.

DETAILED DESCRIPTION OF THE INVENTION

The vehicular antenna object of the invention is represented in Figures from 1 to 3, where it is indicated as a whole by 1.

It can be observed that it comprises a satellite signal amplifier and/or receiver circuit, indicated as a whole by 2, that is supported by an antenna base 3 attachable to the structure of a vehicle A.

Hereinafter the amplifier and/or receiver circuit will be indicated simply with the expression "receiver circuit".

Preferably, but not necessarily, a shaped gasket 4 is interposed between the vehicle A and the antenna base 3, while a protection cover 5 overlaps and is fixed onto the base 3 itself.

Figure 2:
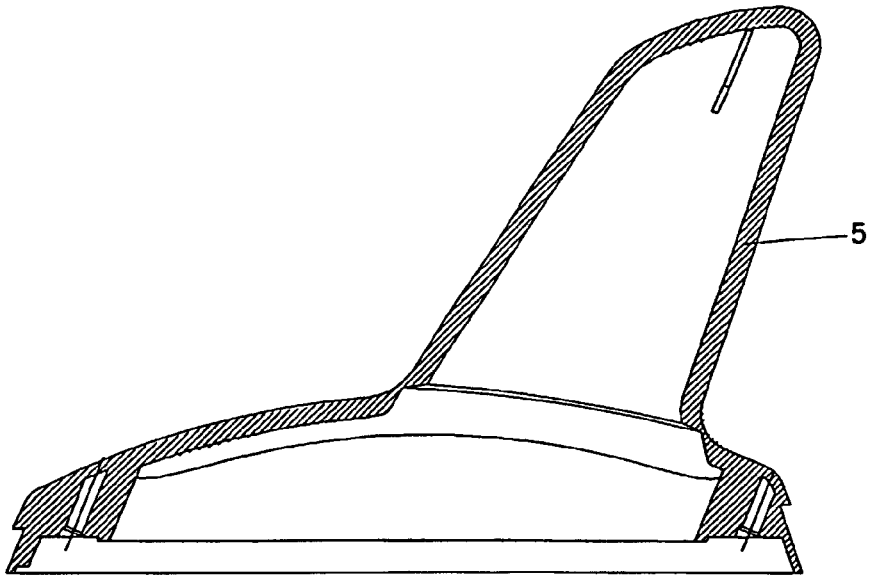
FIG. 2 is an exploded longitudinal sectional view of the antenna object of the invention.
Figure 2:
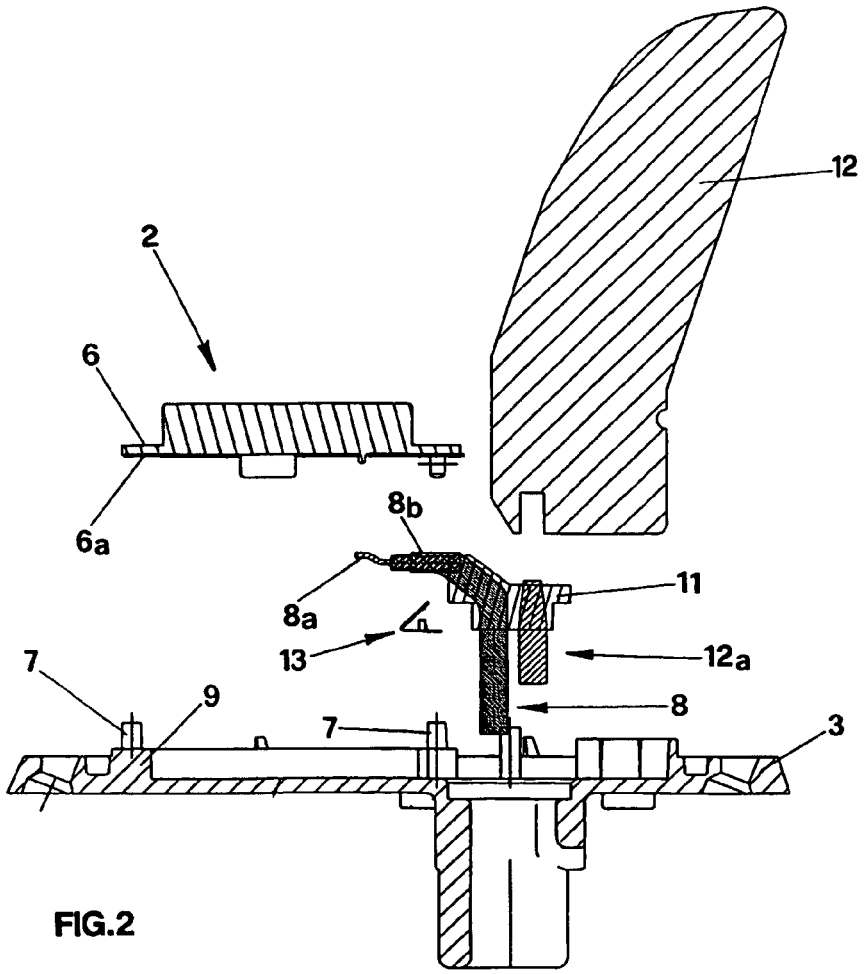
Figure 3:
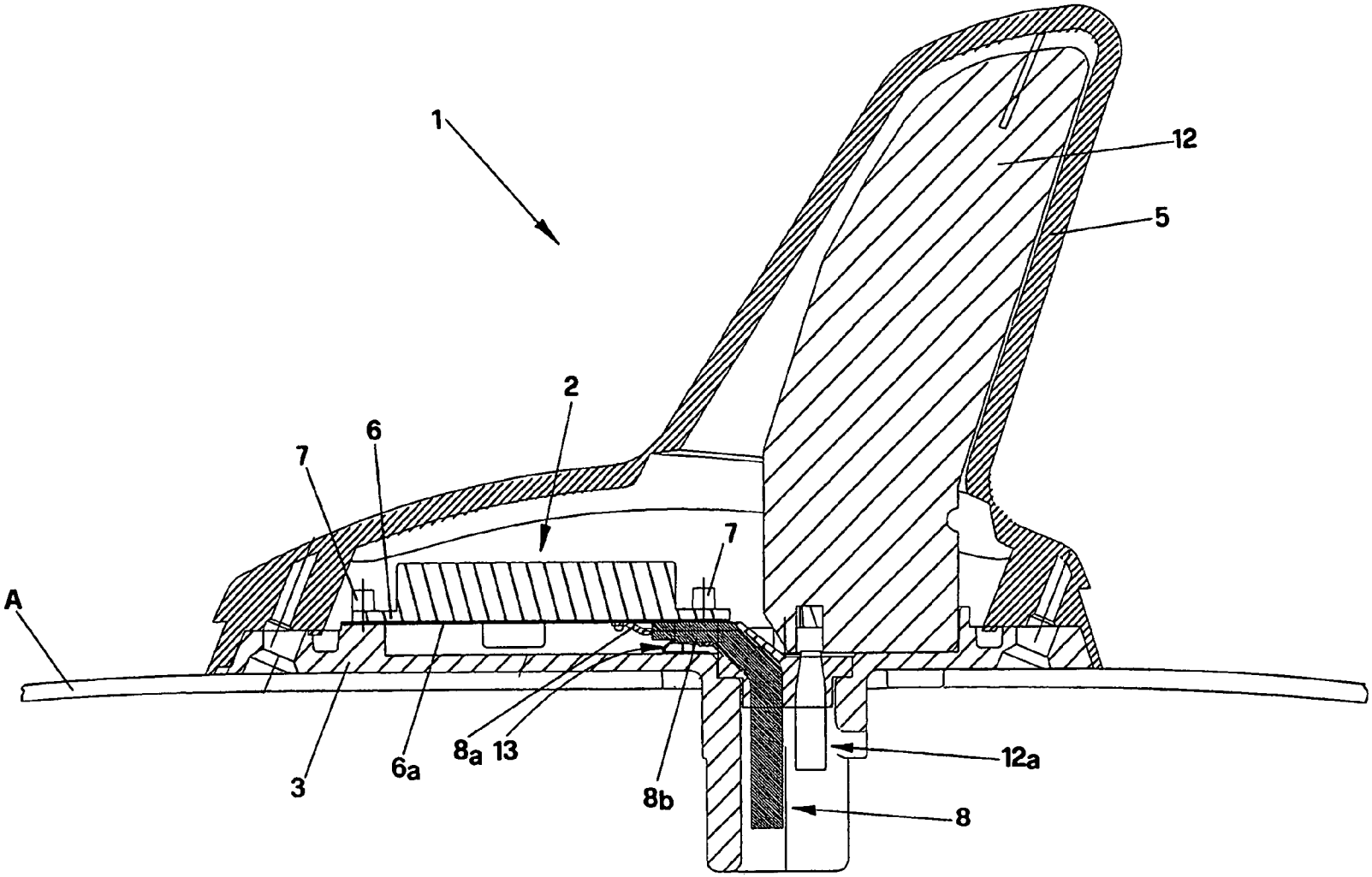
FIG. 3 is a longitudinal sectional view of the antenna of FIG. 2 when assembled.

The satellite signal receiver circuit 2 is assembled onto a board 6 provided with an earth plane 6*a* visible in particular in FIGS. 2 and 3, which serves to achieve electricity continuity with the antenna base 3, made of an electrically conductive material, when the receiver circuit 2 is fixed to it through connection means that consist of rivets 7.

It is evident that the rivets 7 can be replaced by other fixing means, e.g. screws or other means.

The board 6 supports all the electric/electronic components that make up the satellite signal receiver circuit 2, which, by means of a coaxial cable indicated as a whole by 8, is connected to a receiving apparatus, not represented in the figures and installed on the vehicle A.

In particular, it can be observed that the coaxial cable 8 has the electricity conductor 8*a* electrically connected to the satellite signal receiver circuit 2 and the external metallic braiding 8*b* electrically connected, preferably through welding, to the earth plane 6*a*.

Figure 1:
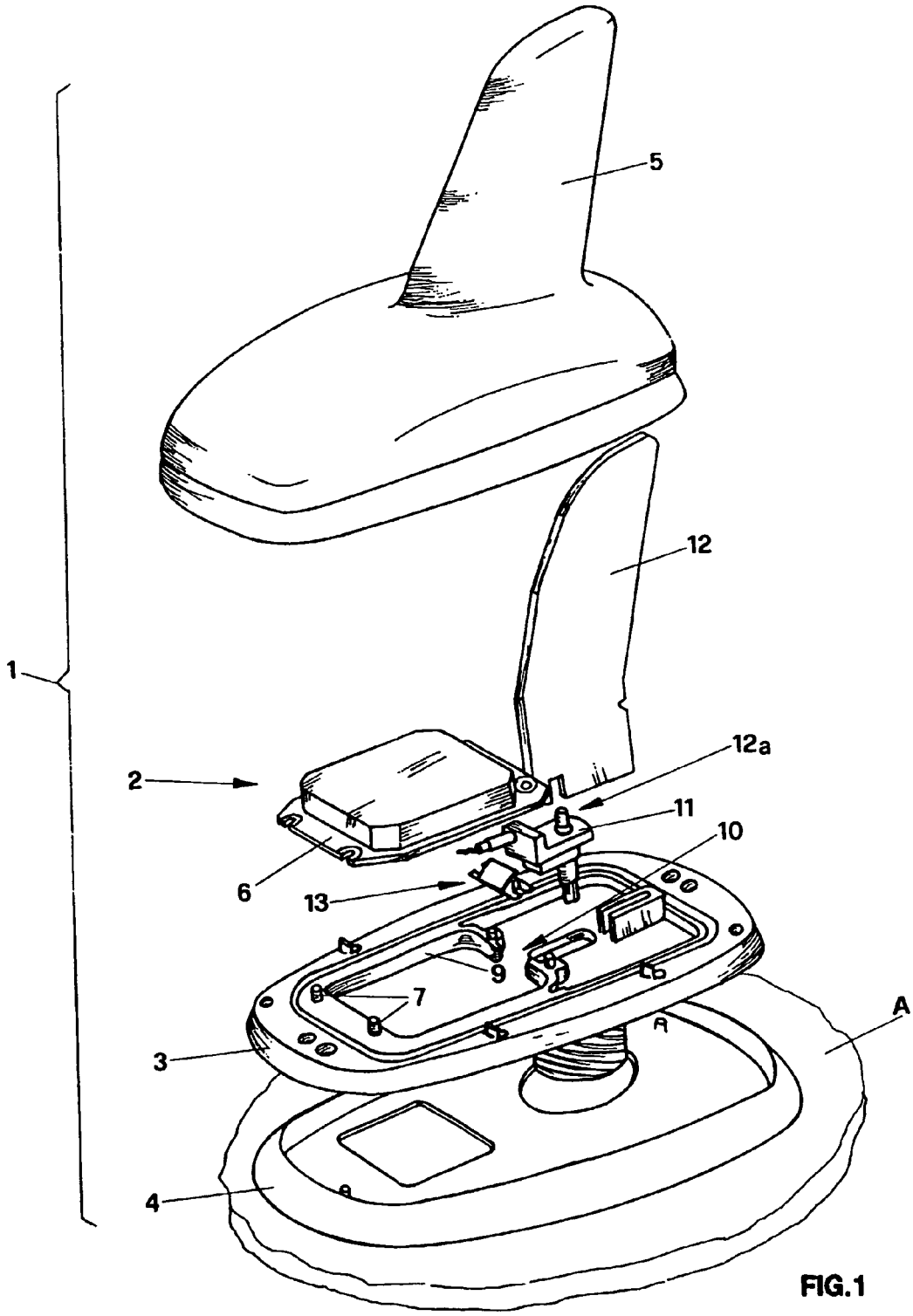
FIG. 1 is an axonometric exploded view of the antenna object of the invention.

When the board 6 is assembled onto the antenna base 3, it rests on an annular edge 9 projecting from the base 3 itself, in which there is an housing, indicated by 10 in FIG. 1. This ensures the passage of the coaxial cable 8, which is incorporated into the shaped body 11, where it is substantially bent at 90°.

A monopole 12, connected to an apparatus for telephone communications through a coaxial cable 12*a* installed in the vehicle A, is also applied to the antenna base 3.

It is mainly through the housing 10 that the satellite signal receiver circuit 2 can receive radiofrequency signals coming from the monopole 12.

According to the invention, in order to avoid the entry of signals from the monopole 12 to the satellite signal receiver circuit 2, electro-conductive elastic means, indicated as a whole by 13, are interposed between the antenna base 3 and the board 6 and are also meant to achieve electricity continuity between the antenna base 3 and metallic braiding 8*b* of the coaxial cable 8, when the connection means 7 fix the board 6 to the antenna base 3.

Figure 4:
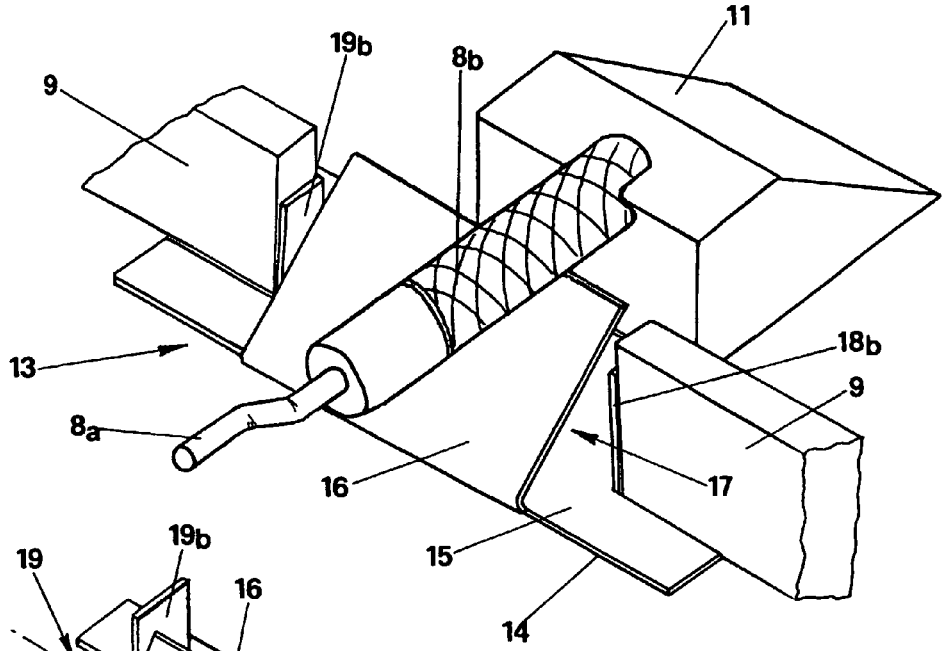
FIG. 4 is an axonometric view of a detail of FIG. 3.
Figure 5:
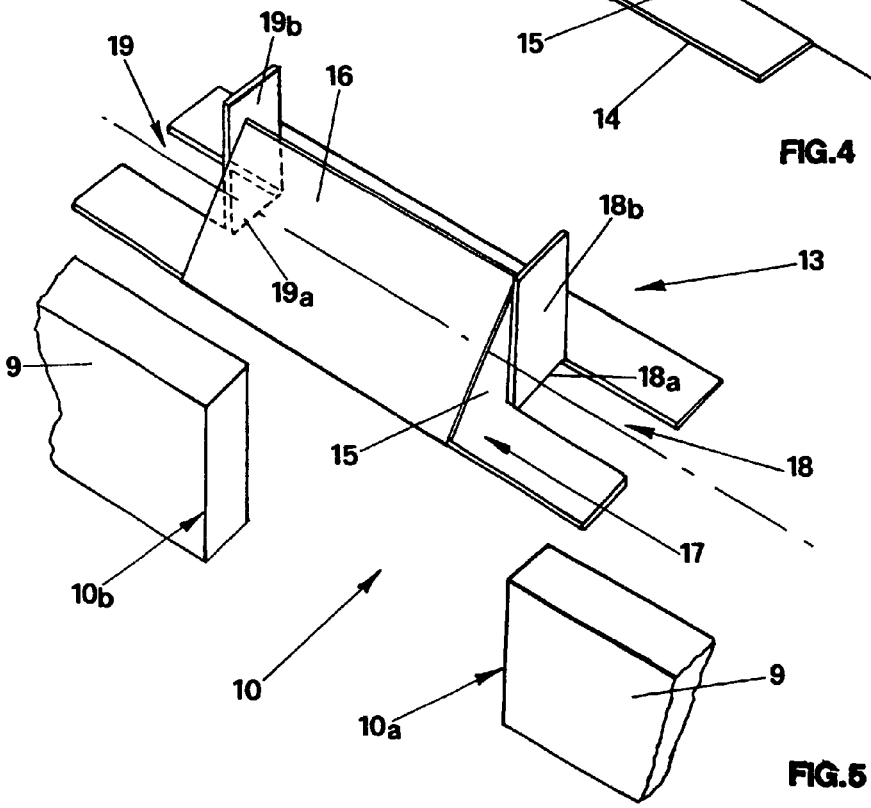
FIG. 5 is an exploded view of a detail of FIG. 2.

In particular, it can be observed in FIGS. 4 and 5 that the electro-conductive elastic means 13 are constituted by an electro-conductive shaped foil 14 that is positioned in the housing 10 of the annular edge 9, in which a first contact surface 15 with the antenna base 3 and a second contact surface 16 with the metallic braiding 8*b* arranged on the outside of the conductor 8*a* of the coaxial cable 8 are defined.

More specifically, the surfaces 15 and 16 are plane concurrent surfaces creating a dihedral angle 17 with transversal V-shaped profile, so as to give elasticity to the foil 14.

In this way, the electro-conductive shaped foil 14 prevents the propagation of the electromagnetic waves of the telephone signal coming from the monopole 12.

The telephone signal and the satellite signal flowing in the coaxial cable 8 are thus separated.

It is clear, therefore, that the use of the above mentioned shaped foil 14 improves the degree of insulation from electromagnetic waves of the amplifier and/or receiver circuit 2 of the satellite signal.

Furthermore, said amplifier and/or receiver circuit 2 is screened with no need to carry out weldings in correspondence with the passage zones of the coaxial cable 8 into the housing 10, thus simplifying the constructive structrure of the antenna 1 in its whole.

To guarantee the stability of the shaped foil 14 on the inside of the housing 10, the first contact surface 15 is provided with lateral indentations 18, 19, which can be observed in FIG. 5, which receive the annular edge 9 projecting from the antenna base 3, when the conductive foil 14 is inserted into the housing 10.

It can also be observed that at the end 18*a*, 19*a* of each one of the lateral indentations 18, 19, an element 18*b*, 19*b* projects from the first surface 15, which, as can be seen in FIG. 4, is positioned along the edges 10*a*, 10*b* that delimit the housing 10, thus guaranteeing the stability of the insertion.

From an operative point of view, to assemble the antenna, the shaped foil 14 is inserted into the housing 10 and then the satellite signal receiver circuit 2 is coupled to the antenna base 3, fixing the edges of the board 6 to the annular edge 9, so that the second surface 16 of the conductive shaped foil 14 is forced against the braiding 8*b* of the coaxial cable 8.

The presence of the foil 14 achieves the double purpose of closing the housing 10 and of improving the ground contact with the earth plane 6*a* of the board 6, thus contributing to the improvement of the degree of insulation of the satellite signal receiver circuit 2 from external signals, especially from those coming from the monopole 12 for telephone communications.

The electro-conductive shaped foil 14 can be in any metallic material, provided that it is a conductive material, or even in a non-metallic material, for example elastomer loaded with conductive elements.

It is clear, therefore, on the basis of the above description, that the antenna object of the invention achieves the purpose of improving the insulation of the satellite signal receiver circuit 2 from external radiofrequency signals.

The aim to make the reception of satellite signals more reliable and of higher quality even and above all during telephone communications is thus achieved. Furthermore, the aim to produce an antenna that is more cost-effective is also achieved, owing to the fact that the screening and the connection welding of the satellite signal receiver circuit 2 to the antenna base 3 are eliminated.

Upon implementation of the antenna object of the invention the shape of the conductive elastic means 13 and of their housing 10 in the antenna base 3 may be varied.

It is understood that these variants and other possible variants that are not described or illustrated herein are all protected by the present patent, provided that they are carried out in compliance with the following claims.

The invention claimed is:

1. Vehicular antenna comprising:

at least one satellite signal amplifier and/or receiver circuit assembled on a board provided with at least one earth plane;

an antenna base for the support of said board, applicable to the structure of a vehicle;

connection means suitable for mechanically fixing said board to said antenna base and for achieving electricity continuity between said antenna base and said at least one earth plane of said board;

a coaxial cable that connects said satellite signal amplifier and/or receiver circuit to a receiving apparatus installed in said vehicle, an electro-conductive elastic means interposed between said antenna base and said board, suited to constitute a barrier to prevent the interference of the telephone communication signal with the satellite communication signal and to achieve electricity continuity between said antenna base and a metallic braiding of said coaxial cable when said connection means fix said board to said antenna base.

2. Vehicular antenna according to claim 1, further comprises a monopole for receiving/transmitting telephone signals, provided with a respective coaxial cable for the connection to a telephone apparatus installed in said vehicle.

3. Vehicular antenna according to claim 2, wherein said electro-conductive elastic means are positioned into a housing obtained in an annular edge projecting from said antenna base on which said board rests.

4. Vehicular antenna according to claim 2, wherein said electro-conductive means consist of an electro-conductive shaped foil, in which a first contact surface with said antenna base and a second contact surface with said metallic braiding are defined, said surfaces being concurrent and forming a dihedral angle with transversal V-shaped profile.

5. Vehicular antenna according to claim 2, wherein said connection means are rivets.

6. Vehicular antenna according to claim 2, wherein said connection means are screws.

7. Vehicular antenna according to claim 1 wherein said electro-conductive elastic means are positioned into a housing obtained in an annular edge projecting from said antenna base on which said board rests.

8. Vehicular antenna according to claim 7, wherein said electro-conductive elastic means are made of elastomer loaded with conductive elements.

9. Vehicular antenna according to claim 7, wherein said electro-conductive means consist of an electro-conductive shaped foil, in which a first contact surface with said antenna base and a second contact surface with said metallic braiding are defined, said surfaces being concurrent and forming a dihedral angle with transversal V-shaped profile.

10. Vehicular antenna according to claim 1 wherein said electro-conductive means consist of an electro-conductive shaped foil, in which a first contact surface with said antenna base and a second contact surface with said metallic braiding are defined, said surfaces being concurrent and forming a dihedral angle with transversal V-shaped profile.

11. Vehicular antenna according to claim 10, wherein said electro-conductive foil is metallic.

12. Vehicular antenna according to claim 10, wherein said first contact surface is provided with lateral indentations that receive said projecting annular edge when said electro-conductive shaped foil is inserted into said housing.

13. Vehicular antenna according to claim 12, wherein at the end of each one of said lateral indentations, an element projects from said first contact surface.

14. Vehicular antenna according to claim 10, wherein said contact surfaces are plane surfaces.

15. Vehicular antenna according to claim 1, wherein said connection means are rivets.

16. Vehicular antenna according to claim 1, wherein said connection means are screws.

* * * * *